United States Patent [19]

Bert et al.

[11] Patent Number: 4,748,727

[45] Date of Patent: Jun. 7, 1988

[54] SNAP FASTENER DEVICE

[76] Inventors: Stephen F. Bert, P.O. Box 546, North Scituate, R.I. 02857; Raymond R. Bert, 105 Turner St., Warwick, R.I. 02886

[21] Appl. No.: 37,169

[22] Filed: Apr. 10, 1987

[51] Int. Cl.[4] ..... A41F 1/00

[52] U.S. Cl. ..... 24/671; 24/662

[58] Field of Search ..... 24/671, 672, 673, 674, 24/675, 622, 623, 624, 295

[56] References Cited

U.S. PATENT DOCUMENTS

| | | | |
|---|---|---|---|
| 1,222,095 | 4/1917 | Galt, Jr. | 24/673 |
| 1,433,785 | 10/1922 | Carr | 24/673 |
| 1,663,673 | 3/1928 | Vodicka | 24/671 |
| 2,541,966 | 2/1951 | Johnson | 24/671 |
| 2,896,287 | 7/1959 | Stultz | 24/671 |
| 3,454,993 | 7/1969 | Jacobson | 24/662 |

FOREIGN PATENT DOCUMENTS

| | | | |
|---|---|---|---|
| 1034679 | 6/1966 | United Kingdom | 24/295 |
| 1206813 | 9/1970 | United Kingdom | 24/295 |

*Primary Examiner*—Victor N. Sakran

*Attorney, Agent, or Firm*—Robert J. Doherty

[57] ABSTRACT

A snap fastener including a conventional first headed part and a second receptor part. The receptor is of sheet-like construction and includes a planar spring panel captured within a housing. The spring panel includes a central cut-out into which fingers extend from opposite sides to form an undersized opening which upon contact with the stud distorts the spring panel to provide the desired closing action therewith.

17 Claims, 2 Drawing Sheets

SNAP FASTENER DEVICE

BACKGROUND AND OBJECTS OF THE INVENTION

This invention relates to a fastener and more particularly to an improved form of snap fastener of the type which normally includes two components each of which are mounted on opposed surfaces such that the surfaces may be interconnected and disconnected at will by the interconnection and disconnection of the component parts. Such snap fasteners are normally used to open and close a wallet, purse, key case, and the like and include a headed snap member attached one part of the item and a receiving or receptor attached to another part. The receptor unit of such commonly known devices normally include a spring mechanism which temporarily enlarges to receive the headed member and thus provides the holding power and the desired snap lock feel to the unit.

The present invention accomplishes these above desired characteristics but additionally utilizes a nonconventional receptor which can be entirely stamped from metal rather than requiring molding or machining techniques and, accordingly, can provide the desired high quality functional and tactile characteristics at a modest cost. In addition, the receptor device of the present invention includes integral means by which such receptor may be attached to the device such as a wallet, purse, and the like. Such use examples are examples only and not made as limitations since the subject device has wide utility and may be applied anywhere its physical characteristics permit.

These and further objects are accomplished by a fastener having a first part having an outwardly projecting enlarged headed member and a second part having a receptor for the respective engaging receipt and release of said headed member, said second receptor part comprising a housing including a bottom panel having outer and inner surfaces and at least one opening through which said headed member may extend, a generally planar spring panel positioned on the inner surface of said bottom panel, retention means upwardly extending from said bottom panel for retaining said spring panel in generally superposed position with said bottom panel, said spring panel including opposed side walls, a pair of upstanding end walls and a central cut out portion continuously longitudinally extending along said spring panel and terminating at opposite ends thereof at said end walls, said spring panel having at least a pair of fingers extending laterally inwardly from opposite sides of said spring panel side walls into said central cut out portion, said fingers terminating in ends longitudinally spaced from each other and disposed in at least partial lateral interdigitation so as to form an opening therebetween for receipt of said headed member, said opening normally sized slightly smaller than the largest cross-section of said headed member such that movement of said headed member thereinto forces said fingers and the respective side walls from which said fingers extend in opposite longitudinal directions so as to distort the shape of said spring panel.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
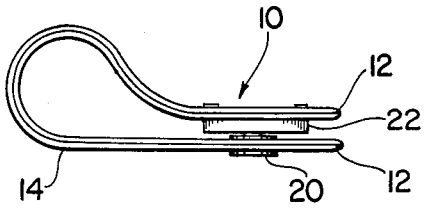
FIG. 1 is an elevated view of a closure flap of the type which may be incorporated in many objects such as purses, wallets, and the like on which the snap fastener device of the present invention may be attached.

Turning now the drawings and particularly FIG. 1 thereof, the innovative snap fastener device 10 of the present invention is shown positioned at opposite ends 12 of a strap 14. It should be pointed out that the strap is depicted for illustrative purposes only and that the device 10 of the present invention may be mounted, positioned, or otherwise attached to almost any supporting surface. Generally such surfaces take the form of thin sheet-like textile-type materials from which wallets, purses, key cases, and the like to which this invention particular utility are made; and in that regard, the device 10 as will hereinafter be more fully explained is provided with particular means by which it may be attached to such supporting surfaces.

The device 10 includes a first conventional enlarged headed member 16 which includes an adjacent narrower portion or stem 18 and a base 20 from which the headed member 16 projects. The base in turn is adapted to be attached to one of the ends 12 (the lower end depicted in the drawings) of the strap 14 by any known means. The terminal portions of the headed members 16 are rounded and preferably the member itself is in the form of a generally bell-shapes stud with a circular cross-section. Such enlarged headed members or studs are commonly used as one of the parts of conventional snap fastening devices.

Figure 2:
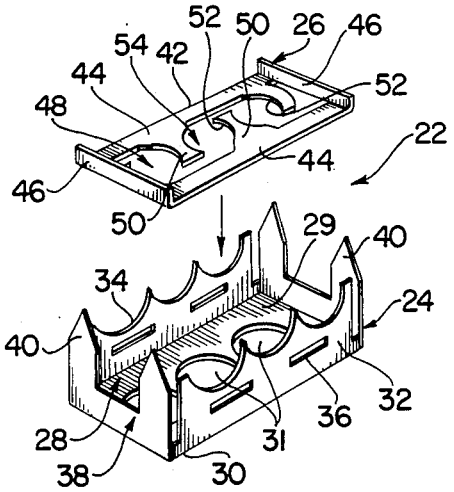
FIG. 2 is an exploded perspective view of the receptor unit of the present invention.
Figure 3:
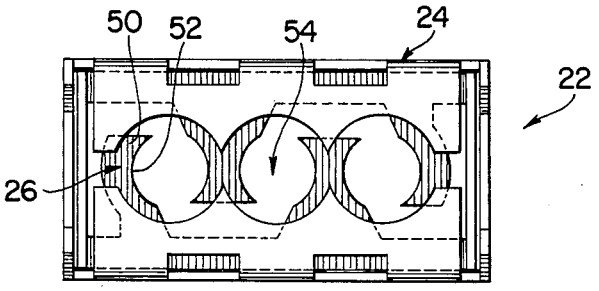
FIG. 3 is a top plan view thereof.

The second part of the device 10 is a receptor 22 for the first part or headed member 16. Such receptor 22 includes a housing 24 in which a spring panel 26 is supported is best shown in FIGS. 2 and 3 of the drawings. The housing 24 includes a bottom panel 28 which has an inner surface 29 and an outer surface 30. The panel 28 is substantially flat and provided with at least one and preferably a plurality of longitudinally aligned holes 31 three of which are shown for purposes of illustration. The housing 24 further includes a pair of opposed upstanding side walls 32 terminating in a crenelated upper edge 34. The side walls 32 are each provided with weakening slots 36 such that the side walls may be inwardly bent towards each other about a line defined by such slots 36 after the spring panel 26 has been placed in supporting contact with the upper or inner surface 29 of the bottom panel 28. As may be apparent by particular reference t FIG. 3 when the side walls 32 are inwardly bent to a substantial flat or normal position with respect to the lower portions of the side walls 32, the spring panel will be mechanically retained within the housing 24.

The housing 24 further includes opposed end walls 38 which terminate in upwardly extending prongs 40. In this regard, it should be pointed out that the prongs 40 are preferably sharp enough to penetrate into and through the strap ends 12 or other supporting surface and once pushed therethrough inwardly bent towards each other so as to affix the housing 24 to the strap 14 or other supporting surface. Generally the housing as well as the spring panel are formed from stamped cut sheet metal such as 0.020 inch brass but other suitable materials including plastic or composite sheet or injection molded or otherwise formed plastic may be utilized. Also contemplated are die cast metal parts although cut and formed sheet metal is the preferable material due to its low cost and ease in forming.

The spring panel 26 is of generally planar construction and includes a body 42 having co-planar side walls 44 and a pair of upstanding end walls 46 at longitudinally opposite ends thereof. The body includes a cut out portion 48 which extends longitudinally continuously along said spring panel and terminates at the opposite ends thereof at the end walls 46. A pair of co-planar fingers 50 extend inwardly from opposite side walls 44. Such fingers 50 include arcuately-shaped ends 52 which extend into the cut out portion 48 a distance so as to define openings 54. Three such openings 54 are depicted and are formed by a pair of fingers 50 extending inwardly from opposed end walls 46. The openings 54 are roughly aligned with the holes 31. It should be pointed out that at least one opening 54 and one aligned hole 31 is necessary and that such opening could be formed by a single finger 50 extending inwardly from each side wall 44. Three openings 54 and holes 31 are depicted such that flexibility to accommodate different spacings of the ends 12 as when a wallet, key case, etc. expands. The fingers 50 of adjacent inwardly extending pairs laterally interdigitate and are longitudinally spaced. The arcuate shape of the ends 52 are configured such that the openings 54 are generally circular to fit the preferred circular configuration of the headed stud 16 and of a radial extent slightly smaller than the largest dimension of the stud such that it is required that the stud force open or flex the spring panel 26 in a manner which will hereinafter be explained.

Figure 4:
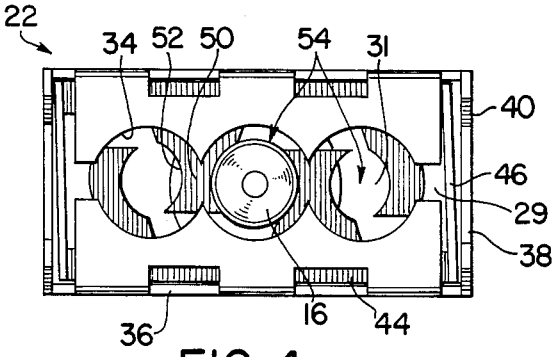
FIG. 4 is a top plan view similar to FIG. 3 but showing the action of the receptor spring member when the snap head is engaged therewith.
Figure 5:
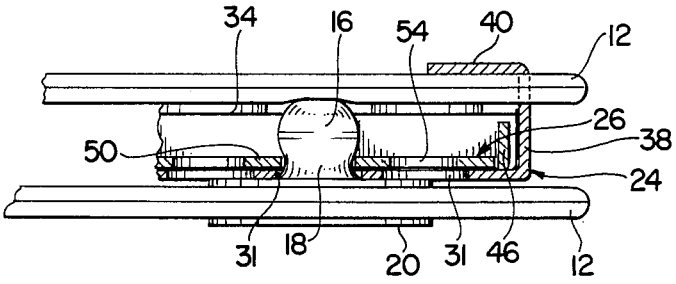
FIG. 5 is an enlarged elevational sectional view of a portion of FIG. 1.
Figure 6:
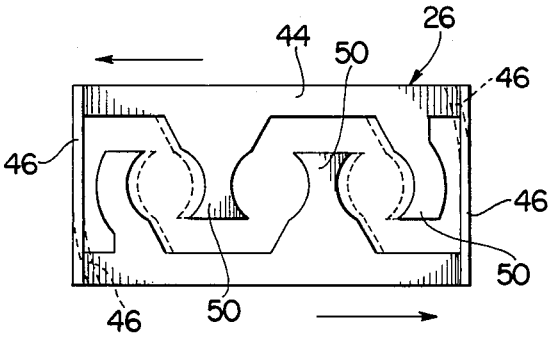
FIG. 6 is a plan view of the spring panel of the receptor unit of the present invention showing the shape distortion imparted thereby by the engagement of the headed snap member such as depicted in the transition between FIGS. 3 and 4.

As the stud 16 is pushed through one of the openings 50 as generally illustrated in the drawings by FIGS. 4, 5, and 6, force is transmitted to the opposed inwardly extending finger pairs in the direction of the arrows shown in FIG. 6 such that force is transmitted to the side walls in opposite longitudinal directions and thus to the end walls 46 such that the end walls will angularly flex such that the spring panel 26 will assume a somewhat parallelogram shape assuming an original rectangular shape. This slight movement of the finger pairs 50 in opposite longitudinal directions along with the side walls 44 affords a smooth and even feel to the closure mechanism as the stud 16 moves through the opening 54. Once the largest portion of the stud is clear the opening, the fingers 50 are able to at least move partially back to their normal position depending on the relative dimensioning of the throat 18 of the stud vis-a-vis the opening 54. This action gives a smooth but defined snap action feel to the closure movement.

It should also be clear that the stud 16 initially moves through one of the bottom panel holes 31 thence through the opening 54 and pass the crenelated side wall upper edges 34 of the housing 24 which are dimensioned such that they do not interfere with the passage of the stud 16 therethrough. The holes 31, the openings 54, and the inward extent of the edges 34 are therefore roughly superposed with each other. The holes 31 as well as the inward extent of the crenelated edges 34 must be such that the headed stud 16 may easily pass therethrough without operational contact, such being afforded entirely by its contact with the spring panel 26. The spring panel is in turn positioned within the housing 24 such that only incidental vertical movement is permitted and such that the end walls 46 contact the end walls 38 of the housing 24. Also while there may be forces applied to the spring panel 26 that would tend to upwardly bow or distort the body 42 from its normal planar or flat overall configuration, the primary and intended flex characteristics brought about by the present device are achieved by the above described movement in opposite longitudinal directions so as to at least temporarily change the geometric configuration of the spring panel, i.e., from rectangular to parallelogram, as above described.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A fastener having a first part having an outwardly projecting enlarged headed member and a second part having a receptor for the respective engaging receipt and release of said headed member, said second receptor part comprising a housing including a bottom panel having outer and inner surfaces and at least one opening through which said headed member is adapted to extend, a spring panel having a planar body panel in turn positioned on the inner surface of said bottom panel, retention means upwardly extending from said bottom panel for retaining said spring panel in generally superposed position with said bottom panel, said spring panel including opposed side walls co-planar with said body panel and a central cut out portion continuously longitudinally extending along said body panel and terminating at opposite ends thereof at a pair of end walls angularly upstanding from said body panel and oriented in a plane other than that of said body panel to form a pair of leaf spring members capable of repeated flexing, said spring panel having at least a pair of fingers extending laterally inwardly from opposite sides of said spring panel side walls into said central cut out portion, said fingers terminating in ends longitudinally spaced from each other and disposed in at least partial lateral interdigitation so as to form an opening therebetween for receipt of said headed member, said opening normally sized slightly smaller than the largest cross-section of said headed member such that movement of said headed member thereinto forces said fingers and the respective side walls from which said fingers extend in opposite longitudinal directions so as to flex said upstanding end wall leaf spring members and consequently distort the shape of said body panel.

2. The fastener of claim 1, said spring panel except for the end walls thereof essentially defined within a single plane, said distorting of said body panel upon movement of said headed member into said spring panel opening being essentially entirely within said single plane.

3. The fastener of claim 2, said receptor housing retention means including opposed end walls upstanding from said bottom panel and against which said spring panel end walls engage, said bottom panel having a hole therethrough, said hole aligned with said spring panel opening such that said headed member extends through both said hole and said opening.

4. The fastener of claim 3, said receptor housing including attachment means for attaching said receptor to a supporting surface.

5. The fastener of claim 3, said receptor housing retention means including a pair of side walls upstanding from said bottom panel and terminating in portions inwardly extending over said spring panel.

6. The fastener of claim 3, said receptor housing retention means including a pair of side walls upstanding from said bottom panel and terminating in portions inwardly extending over said spring panel, said receptor housing side walls overlapping said spring panel to retain said spring panel from substantial vertical movement with respect to said housing bottom panel and said bottom panel end walls engaging said spring panel end walls to prevent substantial longitudinal movement of said spring panel with respect to said bottom panel.

7. The fastener of claim 4, said receptor housing retention means including a pair of side walls upstanding from said bottom panel and terminating in portions inwardly extending over said spring panel, said receptor housing side walls overlapping said spring panel to retain said spring panel from substantial vertical movement with respect to said housing bottom panel and said bottom panel end walls engaging said spring panel end walls to prevent substantial longitudinal movement of said body panel with respect to said bottom panel, said receptor housing bottom panel end walls upwardly terminating in pointed ends in turn adapted to penetrate through said supporting surface and be bent over said supporting surface.

8. The fastener of claim 1, wherein said body panel is normally rectangular in shape and distorts to a parallelogram upon receipt of said headed member.

9. The fastener of claim 1, wherein said headed member includes an adjacent narrower stem portion such that said headed member snap engages with said spring member.

10. The fastener of claim 9, wherein said headed member includes an adjacent narrower stem portion such that said headed member snap engages with said spring member.

11. The fastener of claim 10, wherein said receptor housing side walls terminating in crenelated edges which partially superpose the bottom panel openings.

12. The fastener of claim 1, wherein said spring panel having a plurality of interdigitated fingers inwardly extending from opposite sides to define a plurality of longitudinally aligned and spaced openings and said bottom panel having a plurality of openings which underlie said spring panel openings.

13. The fastener of claim 9, there being two pairs of fingers on each side so as to define three in line openings.

14. The fastener of claim 9, said fingers having arcuate concave portions such that said arcuate concave portions of adjacent opposite side fingers are in face to face disposition to form an essentially circular opening.

15. A fastener having a first part having an outwardly projecting enlarged headed member and a second part having a receptor for the respective engaging receipt and release of said headed member, said second receptor part comprising a housing including a bottom panel having outer and inner surfaces and at least one opening through which said headed member is adapted to extend, a generally planar spring panel positioned on the inner surface of said bottom panel, retention means upwardly extending from said bottom panel for retaining said spring panel in generally superposed position with said bottom panel, said spring panel including opposed side walls, a pair of upstanding end walls and a central cut out portion continuously longitudinally extending along said spring panel and terminating at opposite ends thereof at said end walls, said spring panel having at least a pair of fingers extending laterally inwardly from opposite sides of said spring panel side walls into said central cut out portion, said fingers terminating in ends longitudinally spaced from each other and disposed in at least partial lateral interdigitation so as to form an opening therebetween for receipt of said headed member, said opening normally sized slightly smaller than the largest cross-section of said headed member such that movement of said headed member thereinto forces said fingers and the respective side walls from which said fingers extend in opposite longitudinal directions so as to distort the shape of said spring panel, wherein said spring panel having a plurality of interdigitated fingers inwardly extending from opposite sides to define a plurality of longitudinally aligned and spaced openings and said bottom panel having a plurality of openings which underlie said spring panel openings.

16. The fastener of claim 15, there being two pairs of fingers on each side so as to define three in line openings.

17. The fastener of claim 15, said fingers having arcuate concave portions such that said arcuate concave portions of adjacent opposite side fingers are in face to face disposition to form an essentially circular opening.

* * * * *